US005333789A

United States Patent [19]

Garneys

[11] Patent Number: 5,333,789

[45] Date of Patent: Aug. 2, 1994

[54] SOAP DISPENSER INSERT FOR A SHOWER HEAD

[76] Inventor: David Garneys, 1310 Pinecrest Road, Apt. #605, Ottawa, Ontario, K2C 3N8, Canada

[21] Appl. No.: 932,942

[22] Filed: Aug. 21, 1992

[51] Int. Cl.[5] ..... B05B 7/28

[52] U.S. Cl. ..... 239/318; 239/337; 239/365; 4/605; 4/903

[58] Field of Search ..... 239/310, 317, 318, 365, 239/373, 337; 4/903, 605, 559, 597, 546

[56] References Cited

U.S. PATENT DOCUMENTS

| | | | |
|---|---|---|---|
| 2,058,901 | 10/1936 | McPherson | 239/310 |
| 3,060,956 | 10/1962 | Menzie | 239/365 |
| 3,231,200 | 1/1966 | Heald | 239/318 |
| 3,285,521 | 11/1966 | Coakley | 239/318 |
| 3,581,998 | 6/1971 | Roche | 239/310 |
| 3,763,888 | 10/1973 | Duecker | 239/318 |
| 3,847,354 | 11/1974 | Lemond | 239/317 |
| 4,121,773 | 10/1978 | Headen et al. | 239/317 |
| 4,193,520 | 3/1980 | Duffield | 239/310 |
| 4,218,013 | 8/1980 | Davison | 239/318 |
| 4,858,257 | 8/1989 | Bivens | 4/606 |
| 4,901,765 | 2/1990 | Poe | 239/318 |

FOREIGN PATENT DOCUMENTS

| | | | |
|---|---|---|---|
| 2138676 | 10/1984 | United Kingdom | 4/605 |

*Primary Examiner*—Karen B. Merritt

*Attorney, Agent, or Firm*—Dickinson, Wright, Moon, Van Dusen & Freeman

[57] ABSTRACT

There is provided a new and useful insert for dispersing a liquid additive into a water inlet stream in a conventional shower assembly wherein the assembly includes a water inlet pipe and a shower head assembly, the insert comprising a cylindrical body member having a wall, the member adapted for attaching at one end to the inlet pipe and at an opposite end to the shower head assembly; a baffle within and intermediate the ends of the body, the baffle dividing the body into an inlet and an outlet chamber and having a longitudinal passage therethrough from the first to the second chamber; and first and second passages through the wall, respectively from each of the inlet and outlet chambers.

10 Claims, 1 Drawing Sheet

SOAP DISPENSER INSERT FOR A SHOWER HEAD

FIELD OF THE INVENTION

This invention relates to inserts for dispensing liquid additives into the water inlet stream in a conventional shower assembly. For example, the invention may be used for adding soap to such a stream.

BACKGROUND OF THE INVENTION

A major cause of environmental concern in the residential context revolves around hot water systems. The two most obvious concerns comprise water volume utilized and energy consumption in heating the water.

The first concern has a number of aspects. These include the very substantial overuse of a limited resource and the extra burden placed on treatment facilities for waste water.

In addition to the environmental concerns, heating of water for personal hygiene comprises a significant part of the cost of utilities for typical consumers.

While the proportional cost may be higher in the residential context, the same concerns apply in the industrial and institutional contexts.

The single largest consumer of hot water in the residential context, particularly where a family includes teenaged children, is the shower. Accordingly, anything that can be done to reduce water usage in the shower is of substantial benefit both in the environmental context and in the family budget context.

Against this background the present invention provides a means by which water usage in the shower may be substantially reduced.

Additionally, substantial reductions in soap packaging requirements can be achieved to thereby reduce waste.

An insert for a shower head is provided which allows, inter alia, soap to be dispensed directly into the water inlet stream. The amount of water consumed in "soaping up" can thus be very substantially reduced. As well, soap usage can be substantially reduced in comparison to commonly used bar soap.

PRIOR ART

A substantial number of devices have been developed over a period of years which are directed at the provision of a practical means of introducing a liquid additive such as soap into the water stream flowing through a shower head assembly. To date there has been no such system which has been sufficiently practical to be brought into common use. The following U.S. patents are of interest.

U.S. Pat. No. 3,231,200, granted Jan. 25, 1966, to Heald, provides a rather complicated mechanism for introducing and metering liquid soap. The device also provides for introduction of atmospheric air into the soap stream prior to the soap stream being drawn into the water stream. The actual means for drawing the soap stream into the water stream comprises a coupling providing a gradually tapering restrictive passage for the water stream.

U.S. Pat. No. 3,285,521, issued Nov. 15, 1966, to Coakley, illustrates a shower head assembly in which the inlet tube to the shower head is replaced by an inlet tube having a valve attached to it and which valve in turn has a soap container threadedly attached to it. A tube leads from the soap container to the valve and a second tube leads from the valve into the inlet tube and along the inlet tube to project into a shower head. The latter tube is provided with a forwardly extending flexible section which is able to flex as the shower head is rotated. Of note the assembly undesirably provides a clear and unobstructed flow of part of the inlet stream directly through the entire assembly without breakup into a spray.

U.S. Pat. No. 3,763,888, issued Oct. 9, 1973, to Duecker, provides a coupling which forms a venturi in an inlet water stream to draw liquid soap or the like into the stream. The patent is actually directed at an integral valve mechanism for controlling the entry of soap or the like into the water stream.

U.S. Pat. No. 4,193,520, issued Mar. 18, 1980, to Duffield, discloses a complete shower head assembly having an integral means for introducing soap or the like into the water stream and having a quick on/off feature. The assembly includes an integral narrowed section in the inlet tube to provide a venturi effect to draw soap into the stream.

U.S. Pat. No. 4,218,013, issued Aug. 19, 1980, to Davison, provides a very complex shower head assembly for drawing a selected one of a group of additive liquids into the inlet water stream. A coupling in the inlet pipe provides a series of channels of varying diameters which ultimately result in a venturi effect drawing liquid into the stream and also providing a venting channel.

U.S. Pat. No. 4,858,257, issued Aug. 22, 1989, to Bivens is directed at a shower stall having an elongated vertically oriented body brush and a venturi system for injecting various liquid additives into water sprayed on the brush.

Finally, U.S. Pat. No. 4,901,765, issued Feb. 20, 1990, to Poe, provides a further example of a system for drawing a liquid soap into the inlet water stream of a shower head assembly. A coupling is provided which includes a passage of varying diameter to create a venturi effect. The coupling includes vacuum control means for controlling the vacuum generated by the venturi arrangement.

BRIEF SUMMARY OF THE INVENTION

An insert has now been devised for insertion between a water inlet pipe and a shower head assembly in which the insert is very simple in operation and durable in construction, and at the same time very economical to produce.

Thus the invention provides an insert for dispensing a liquid additive into a water inlet stream in a conventional shower assembly wherein the assembly includes a water inlet pipe and a shower head assembly, the insert comprising a cylindrical body member having a wall, the member adapted for attaching at one end to the inlet pipe and at an opposite end to the shower head assembly, a baffle within and intermediate the ends of the body, the baffle dividing the body into an inlet and an outlet chamber and having a longitudinal passage therethrough from the first to the second chamber, and first and second passages through the wall, respectively from each of the inlet and outlet chambers.

BRIEF DESCRIPTION OF THE DRAWINGS

In drawings which illustrate embodiments of the invention.

Figure 1:
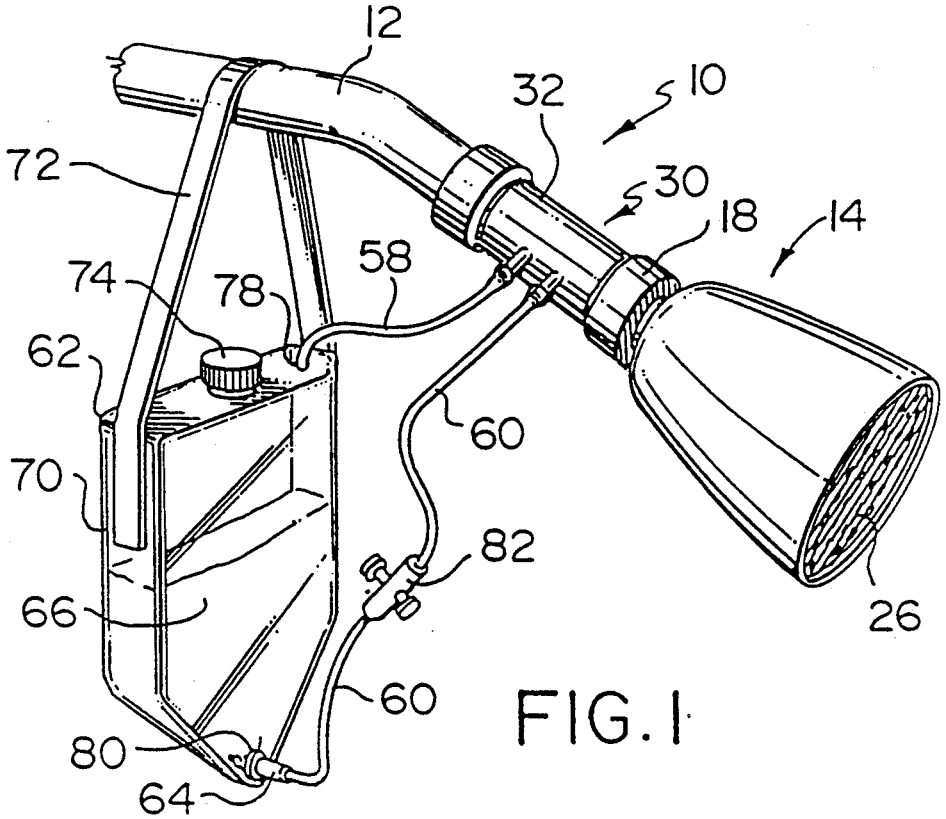
FIG. 1 is a perspective view of a shower head assembly with the invention installed.
Figure 2:
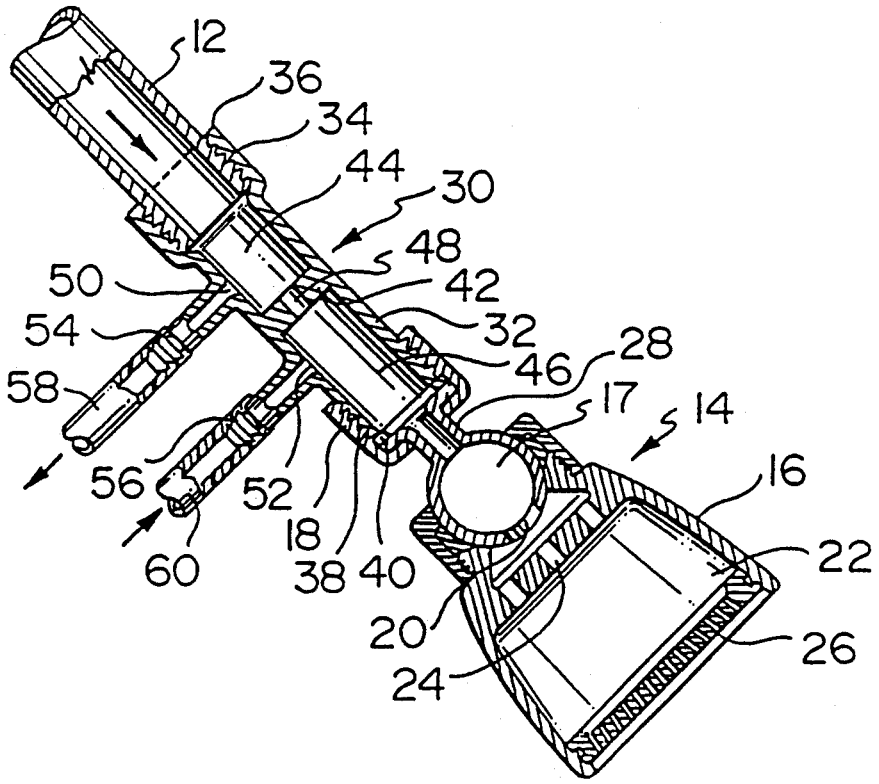
FIG. 2 is a cross-section through an insert according to the invention and a shower head assembly.

While the invention will be described in conjunction with illustrated embodiments, it will be understood that it is not intended to limit the invention to such embodiments. On the contrary, it is intended to cover alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

A shower assembly 10 in conventional form comprises an inlet pipe 12 and shower head assembly 14. It is usual for the inlet pipe 12 to comprise a short dogleg pipe threaded at an inlet end for connection to a water supply pipe (not illustrated) and threaded at an outlet end for connection to shower head 14.

Shower head assembly 14 conventionally comprises the head proper 16, the hollow ball 17 and the collar 18. In the usual arrangement currently in use, the collar 18 would be threadedly connected directly to the inlet pipe 12. Another common arrangement (not illustrated) is to interpose an elongated flexible tube between the shower head assembly proper and the inlet tube so that the shower head can be "hand-held". In this situation, the flexible tube is then threadedly attached to inlet pipe 12.

The shower head proper 16 is seated about ball 17 for universal rotation but normally through fairly restricted angular distances. The shower head proper 16 may have a variety of chambers 20 and 22 joined by passages such as 24 and terminating in a spray plate 26.

The hollow ball 17 includes a shower assembly inlet or neck part 28 which is conventionally held in abutting relation with inlet pipe 12 by collar 18.

Any conventional shower assembly is suitable for use with the invention either directly or with minor and straightforward adaptation.

In the present invention the insert 30 is interposed between the inlet pipe 12 and the shower head 14. Insert 30 is conveniently in the form of a cylindrical tube or body 32 having internal threads 34 at inlet end 36 and external threads 38 at outlet end 40. Insert 30 is thus installed within the assembly 10 by threadedly engaging threads 34 with the correspondingly threaded end of inlet pipe 12 and by threadedly engaging collar 18 on threads 38.

The body 32 of insert 30 includes a transverse wall or baffle 42 intermediate the ends 36 and 40. Baffle 42 divides body 32 into a first chamber 44 and second chamber 46.

A longitudinal passage 48 through baffle 42 connects inlet chamber 44 with outlet chamber 46.

First and second passages 50 and 52 through the wall of body 32 provide a means for connecting the inlet chamber 44 and outlet chamber 46 respectively to a source of liquid additive for the shower water stream. In the preferred case, the ribbed connectors 54 and 56 are included integral with body member 32 for receiving flexible plastic tubing 58 and 60.

The plastic tubing 58 and 60 leads to an upper part 62 and a lower part 64 of a liquid additive dispenser 70. The dispenser 70 is conveniently provided with a strap 72 from which it may be suspended from inlet pipe 12.

A liquid additive 66 which in the most common case will be a liquid soap can be added to the dispenser 70 through an opening closed by cap 74.

The tube 58 extends between inlet chamber 44 and an opening 78 in the upper section 62 of dispenser 70. The opening 78 should be positioned such that it is above the highest level of liquid 66 which will be reached in the dispenser 70.

Tubular member 60 extends from the outlet chamber 46 of insert 30 to an opening 80 adjacent the bottom section 64 of dispenser 70.

A valve 82 is preferably provided in the tubing 60. The preferred valve is a simple on/off pushbutton operated one.

The insert operates as follows. When the shower is not operating; i.e. when no water is flowing through inlet pipe 12, the system will be at ambient pressure.

When the shower is turned on so water flows through the body 32 of insert 30 and through the passage 48 in baffle 42, the constriction formed by baffle 42 causes a high pressure area to be created in the inlet chamber 44 and a low pressure area adjacent opening 52 in outlet chamber 46.

The higher pressure of the inlet chamber 44 acts on the dispenser 70 through passage 50 and tubing 58.

When the valve 82 is switched to the on position, the higher pressure water in inlet chamber 44 will transmit pressure through passage 50 and along tubing 58 to dispenser 70. Liquid from the dispenser will then be forced by the higher pressure through tube 60 and into the main water stream in outlet chamber 46.

Because of the initial separation or layering of the water and the additive in container 70, little or no mixing between water and additive will occur in container 70.

The on/off valve will be configured in such a way that a proper amount of liquid additive is permitted to pass through the valve.

When sufficient soap or other liquid has been applied to an individual taking the shower, the valve is switched off so that the individual then receives clear water for rinsing.

The insert 30 is preferably a one-piece molded plastic unit.

In a typical case, the baffle 42 need only be thick enough to have sufficient strength. In one prototype a thickness of $\frac{3}{8}$ inch was chosen. Passage 48 through baffle 42 is typically approximately $\frac{1}{8}$ to 3/16 inch in diameter.

Passages 50 and 52 may also be varied to suit the additive requirements but might typically be in the order of $\frac{1}{8}$ to $\frac{1}{4}$ inch inside diameter. In use the tubing 58 and 60 is preferably of like diameter and of plastic.

The overall length of the insert 30 is preferably as short as it convenient to accommodate the various parts of the insert.

Thus it is apparent that there has been provided in accordance with the invention a liquid dispenser insert for a shower head that fully satisfies the objects, aims and advantages set forth above. While the invention has been described in conjunction with a specific embodiment/specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention is:

1. An insert for dispensing a liquid additive into a water inlet stream in a conventional shower assembly wherein the assembly includes a water inlet pipe and a shower head assembly, said insert comprising:

a cylindrical body member having a wall, said member adapted for attaching at one end to said inlet pipe and at an opposite end to said shower head assembly;

a baffle within and intermediate the ends of said body, said baffle dividing said body into an inlet and an outlet chamber and having a longitudinal passage therethrough from said inlet to said outlet chamber; and first and second passages through said wall, respectively from each of said inlet and outlet chambers;

a dispenser for holding a liquid to be added to a water stream flowing through said body;

a first tubular member extending from said first passage to said dispenser and opening into said dispenser at a level above the highest level to be reached by a liquid in said dispenser;

said dispenser having an opening adjacent a bottom section thereof; and a second tubular member extending from said opening in said dispenser to said second passage.

2. The insert of claim 1 including means on said body proximate each of said first and second passages for connecting each of said first and second passages to respective said first and second tubular members.

3. The insert of claim 2 wherein said means on said body comprises first and second ribbed connectors for connecting respectively first and second ones of said pair of passages to said first and second tubular members.

4. The insert of claim 1 wherein said baffle is about $\frac{3}{8}$ inch thick.

5. The insert of claim 1 wherein said longitudinal passage is about $\frac{1}{8}$ to 3/16 inch in diameter.

6. The insert of claim 1 wherein each of said first and second passages is about $\frac{1}{8}$ to $\frac{1}{4}$ inch in diameter.

7. The insert of claim 1 including valve means for closing off at least one of said first and second tubular members.

8. The insert of claim 7 wherein said valve means is on said second tubular member.

9. The insert of claim 7 wherein said valve means is an on/off valve.

10. An insert for dispensing a liquid additive into a water inlet stream in a conventional shower assembly wherein the assembly includes a water inlet pipe and a shower head assembly, said insert comprising:

a cylindrical body member having a wall, said member adapted for attaching at one end to said inlet pipe and at an opposite end to said shower head assembly;

a transverse baffle within and intermediate the ends of said body, said baffle having an opening therethrough joining an inlet to an outlet end of said member;

first and second passages through said wall, one on an inlet and one on an outlet side of said baffle;

a dispenser for holding a liquid to be added to a water stream flowing through said body;

a first tubular member extending from said first passage to said dispenser and opening into said dispenser at a level above the highest level to be reached by a liquid in said dispenser;

said dispenser having an opening adjacent a bottom section thereof;

a second tubular member extending from said opening in said dispenser to said second passage; and valve means for closing off at least one of said first and second tubular means.

* * * * *